US010004963B2

(12) United States Patent
Crosby et al.

(10) Patent No.: US 10,004,963 B2
(45) Date of Patent: Jun. 26, 2018

(54) TRANSPORTABLE BASKETBALL TOURNAMENT SYSTEM

(71) Applicant: Gared Holdings, LLC, Noblesville, IN (US)

(72) Inventors: William D. Crosby, Greenwood, IN (US); Kevin R. Needler, Fishers, IN (US)

(73) Assignee: GHL Acquisition, LLC, Nashville, TN (US)

( * ) Notice: Subject to any disclaimer, the term of this patent is extended or adjusted under 35 U.S.C. 154(b) by 287 days.

(21) Appl. No.: 14/174,094

(22) Filed: Feb. 6, 2014

(65) Prior Publication Data

US 2014/0235375 A1 Aug. 21, 2014

Related U.S. Application Data

(60) Provisional application No. 61/765,445, filed on Feb. 15, 2013.

(51) Int. Cl.
*A63B 63/08* (2006.01)

(52) U.S. Cl.
CPC ..... *A63B 63/083* (2013.01); *A63B 2210/50* (2013.01); *A63B 2243/0037* (2013.01); *Y10T 29/49826* (2015.01)

(58) Field of Classification Search
CPC ..... A63B 63/083; A63B 2210/50; A63B 69/0071; A63B 2243/0037; Y10T 29/49826
See application file for complete search history.

(56) References Cited

U.S. PATENT DOCUMENTS 3,598,406 A * 8/1971 Robinson ..... A63B 9/00 473/481
4,133,509 A * 1/1979 Kalbow ..... A47K 1/09 248/221.11

(Continued)

FOREIGN PATENT DOCUMENTS

WO WO 97/33661 A1 9/1997

OTHER PUBLICATIONS

International Search Report, dated May 22, 2014, International Patent Application No. PCT/US2014/015477, pp. 1-11, International Searching Authority, Moscow, Russia.

*Primary Examiner* — Melba Bumgarner
*Assistant Examiner* — Amir Klayman
(74) *Attorney, Agent, or Firm* — Brinks Gilson & Lione

(57) ABSTRACT

An easily transportable basketball goal system includes a base having a post coupling fixed thereto, a post including a base coupling on lower end and an arm coupling on an upper end, an arm assembly including a post coupling fixed to a first end, the post coupling on the arm assembly engaging the arm coupling on the post, the arm assembly including a backboard coupling fixed to a second end, a backboard including an arm coupling fixed to a rear surface, the arm coupling of the backboard engaging the backboard coupling fixed to the arm assembly, the backboard including a basketball rim coupling fixed to a front surface, and a basketball rim assembly including a backboard coupling engaging the rim coupling on the front surface of the backboard, each coupling being designed to permit quick disassembly of the goal system into component elements.

20 Claims, 16 Drawing Sheets

(56) References Cited

U.S. PATENT DOCUMENTS 4,613,135 A * 9/1986 Rush ..... A63B 63/083 248/223.41
4,805,904 A * 2/1989 Nye ..... A63B 63/083 248/284.1
4,815,734 A * 3/1989 Verhulst ..... A63B 63/083 248/297.21
4,846,469 A * 7/1989 Nye ..... A63B 63/083 473/486
4,887,812 A * 12/1989 Moormann ..... A63B 63/083 248/224.61
4,921,248 A * 5/1990 Rapp ..... A63B 63/083 248/222.13
5,100,132 A 3/1992 Anderson et al.
5,316,290 A * 5/1994 Parr ..... A63B 63/083 473/483
5,480,139 A * 1/1996 Owen, Jr. ..... A63B 63/083 473/485
5,586,759 A * 12/1996 Fitzsimmons ..... A63B 63/083 473/486
5,672,130 A * 9/1997 O'Connell ..... A63B 63/083 473/483
5,759,121 A * 6/1998 Rogers ..... A63B 63/083 248/222.13
6,123,314 A * 9/2000 Steele ..... F16B 5/0642 248/222.11
6,758,768 B2 * 7/2004 Spencer ..... A63B 69/0071 473/472
6,824,481 B1 11/2004 Nye et al.
6,958,022 B2 * 10/2005 O'Neill ..... A63B 63/083 473/479
6,976,945 B1 * 12/2005 Lim ..... A63B 23/0211 482/148
7,175,551 B1 * 2/2007 Hamilton ..... A63B 63/083 473/486
7,407,453 B2 8/2008 Shannon
7,794,342 B2 9/2010 Connerley et al.
7,967,705 B2 6/2011 Connerley et al.
2007/0178994 A1 * 8/2007 White ..... A63B 63/083 473/481
2007/0191151 A1 * 8/2007 Nye ..... A63B 63/083 473/479
2008/0090682 A1 4/2008 Kilpatrick
2009/0137347 A1 * 5/2009 Jenkins ..... A63B 69/0071 473/433
2012/0252607 A1 * 10/2012 Shepherd ..... A63B 63/083 473/483

* cited by examiner

TRANSPORTABLE BASKETBALL TOURNAMENT SYSTEM

CROSS-REFERENCE TO RELATED APPLICATION

This application is related to and claims all benefit of U.S. Provisional application Ser. No. 61/765,445 filed Feb. 15, 2013.

BACKGROUND

Technical Field

This invention relates to basketball goals generally consisting of a backboard assembly and a basketball goal support assembly. More particularly, the present invention relates to such a goal where various elements of the backboard assembly and basketball goal support can be decoupled from each other for efficient transportation and quickly recoupled at a new site of use.

Background Information

The game of basketball is popular throughout the world. Part of its popularity may stem from the simplicity of equipment used, i.e., at least one elevated basket and a ball. More commonly, the equipment is at least one basketball goal, which includes a backboard, a rim assembly, a basketball goal support, and a basketball. Additionally, its popularity may stem from the fact that basketball can be played outdoors and indoors, which lends itself to be played year round.

Amateur basketball tournaments are an increasingly popular phenomenon, particularly in the United States. Such tournaments typically are three-on-three basketball tournaments conducted in an outdoor location on the streets or in a parking lot of the town or city in which the tournament is organized. Popular tournaments may draw hundreds of teams and thousands of spectators. A tournament of this nature requires portable basketball goal assemblies, wherein the basketball goals can be transported to the location by truck, set up easily, and disassembled and moved to a new location just as easily.

Various basketball goals have been conceived to allow for a quick assembly, disassembly, and/or replacement. However, there remains a need for basketball goals that can be quickly assembled at a first location, subsequently quickly disassembled and efficiently packed in a minimum of space for transport to a new location.

BRIEF SUMMARY

The shortcomings of the prior art can be addressed generally by a basketball goal constructed to include a plurality of couplings that permit the quick assembly and disassembly of the goal, the couplings being positioned so that, when disassembled, the components elements of the goal can be commonly grouped together to occupy a minimum of space. The basketball goal can include a base, one or more posts coupled to the base, a support arm coupled to an upper end of each post, a backboard coupled to a distal end of the support arm and a basketball rim coupled to the backboard, with each coupling being design to permit quick disassembly of the goal into its component elements. The base can include a double ended frame having a post coupling fixed to each end of the frame. The post can include a base coupling at a lower end and a support arm coupling at an upper end. The support arm can include a post coupling at a proximal end and a backboard coupling at a distal end.

The backboard can include a support arm coupling on a back surface and a rim coupling on a front surface. The basketball rim can include a backboard coupling. Each coupling can be designed to permit quick disassembly of the goal into its component elements, and quick assembly of the component elements into a basketball goal.

The base can comprise a generally rectangular, round or tubular frame including a pair of parallel side bars having a lower surface for ground support. A pair of end bars can be fixed to ends of the parallel side bars. Each of the end bars can also include a lower surface for ground support. A post coupling can be fixed to an upper surface of the end bars. The post coupling can comprise a hinge defining element at an outer edge and an engagement element at an inner edge.

The post can comprise a base coupling fixed to a lower end of the post. The base coupling can include a hinge defining element located along a forward edge and an engagement element at a rearward edge. The base coupling can be secured to the post lower end by a plurality of gussets. The post upper end can include a support arm coupling. The support arm coupling can comprise pins projecting laterally on each side of the post. The support arm coupling can also include at least one lateral opening through the post sized to receive a fastener The support arm can comprise a first arm and second arm. Distal ends of the first and second arms can be fixed, respectively, to an upper portion and a lower portion of a post coupling. Proximal ends of the first and second arms can be fixed adjacent to each other to a backboard coupling. The first and second arms, post coupling, and backboard coupling can form a generally trapezoidal structure. The support arm can additionally include an upper backboard support. The upper backboard support can include a pair of struts having first ends pivotally coupled to the post coupling and second ends including an upper backboard engaging element. The post coupling can include a vertical channel member sized to straddle the post upper end. The channel member can include a pair of slots adapted to engage pins projecting laterally on each side of the post. The channel member can include additional openings for receiving a fastening element. The backboard coupling can include a plate fixed to the distal ends of the first and second arms. A left flange and a right flange can extend forwardly from opposite sides of the plate. The flanges can include a slot adapted to receive a laterally extending connecting pin. A pin can project laterally from outside surfaces of the left and right flange.

The backboard can include a frame member on a rear surface. The frame member can include a support arm coupling at a lower central location. The support arm coupling can include webs projecting rearward from the frame member spaced sufficiently from each other to straddle the backboard coupling. Each web can include a downwardly open slot adapted to receive a laterally projecting pin of the backboard coupling. Each web can also include an opening to receive a connecting pin that extends though the slot of the backboard coupling. The frame member can also include laterally spaced members including fastening elements to couple to the second ends of the backboard supporting struts.

The basketball rim backboard coupling can be fixed to a rear surface of a break-away or a stationary rim support assembly, which is fixed to a basketball rim. A rim assembly coupling can be fixed to a front surface of the backboard that is designed to quickly and securely engage the basketball rim backboard coupling.

In one embodiment, the system contemplates a plurality of basketball goals assembled for a tournament. For example, the system can include twelve bases, and sixteen of each of the other components to form eight basketball courts. When disassembled and stacked, the twelve bases would occupy a volume of less than 160 cubic feet. When disassembled and stacked, the sixteen posts would occupy a volume of less than 170 cubic feet. When disassembled and stacked, the sixteen support arm assemblies would occupy a volume of less than 95 cubic feet. When disassembled and stacked, the sixteen backboards would occupy a volume of less than 160 cubic feet. When disassembled and stacked, four of the sixteen basketball goal assemblies, enough for a total of sixty-four basketball goals to equip thirty two courts, can be loaded into a standard 53 foot truck, which is far less volume than is required by prior systems.

For the purposes of promoting an understanding of the principles of the invention, reference will now be made to the embodiments illustrated in the drawings, and specific language will be used to describe the same. It should nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

DETAILED DESCRIPTION OF THE DRAWINGS AND THE PRESENTLY PREFERRED EMBODIMENTS

Figure 1:
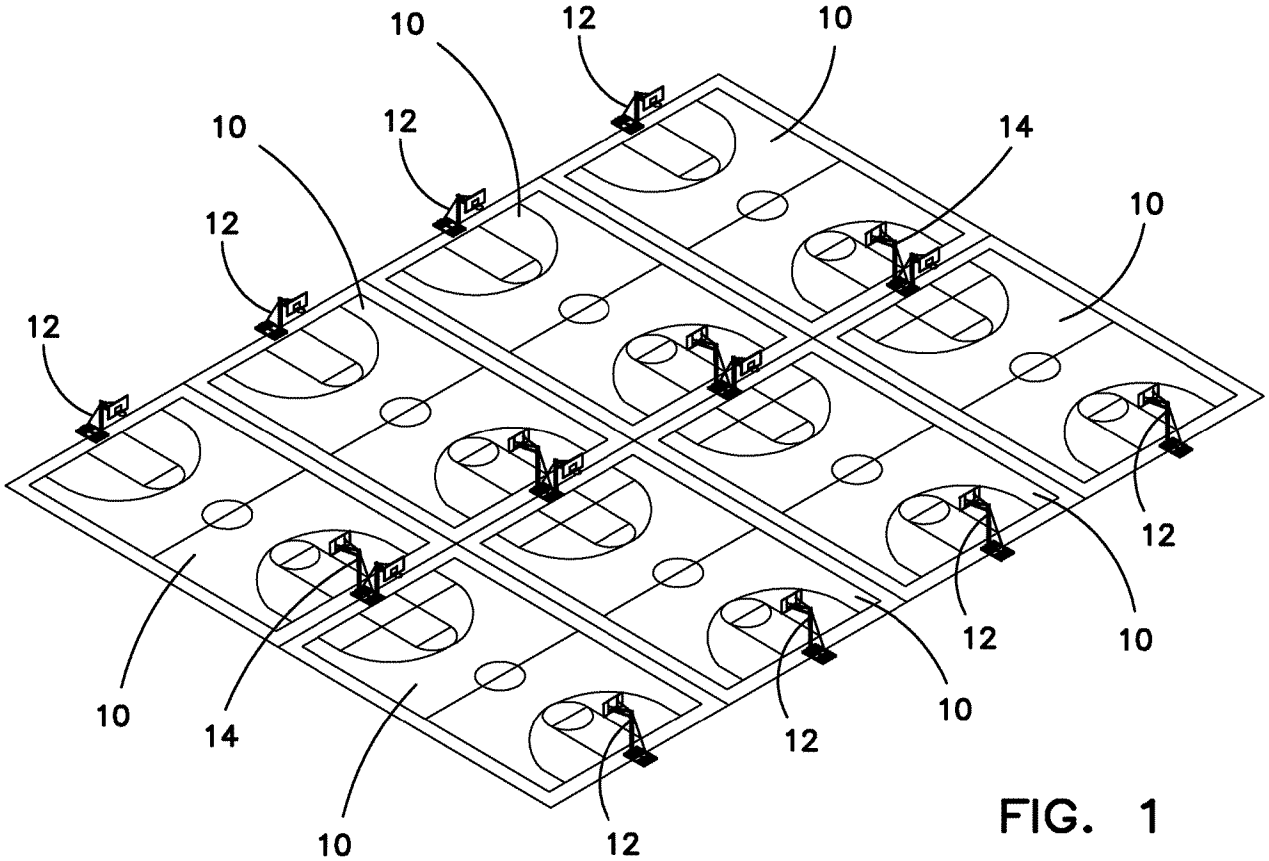
FIG. 1 is a perspective view of apparatus of the present system set up in eight adjacent courts.
Figure 2:
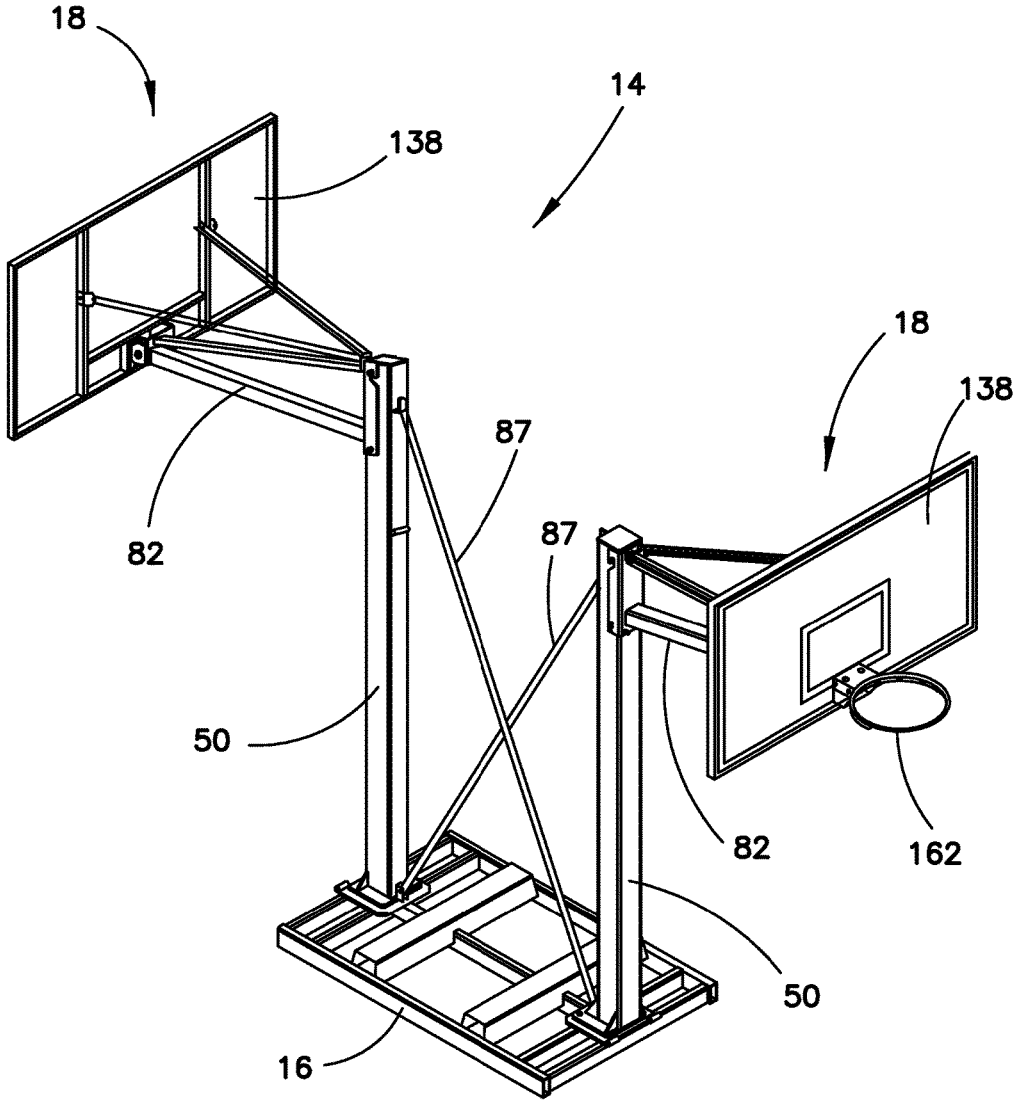
FIG. 2 is a perspective view of two basketball goals on a common base as used between adjacent courts.
Figure 3:
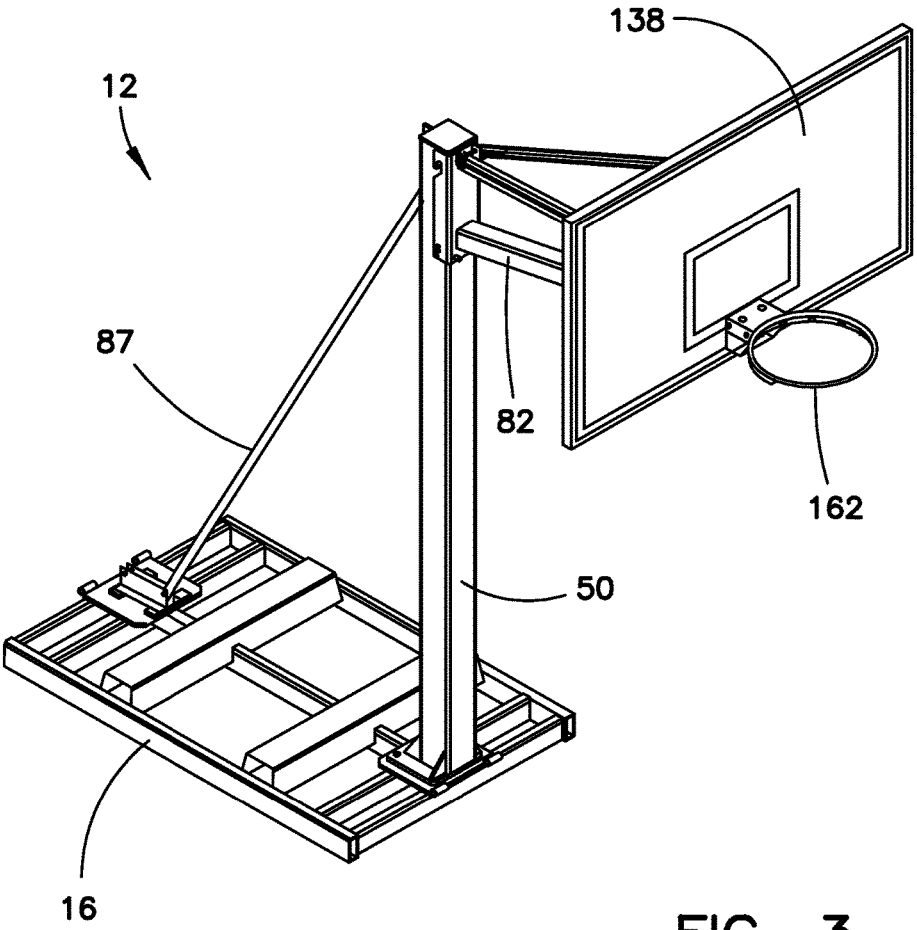
FIG. 3 is a perspective view of a single end basketball goal as used at an end of a court.

FIG. 1 is a perspective view of apparatus of the present system set up in eight adjacent courts 10. The number of courts is not critical, but rather merely typical of a three-on-three or a regular basketball tournament. Each court 10 is shown to include an outside or end goal assembly 12 and a joint goal assembly 14. The joint goal assembly 14 can include a base 16 that is shared by two goals 18 positioned back-to-back as shown in FIG. 2. The end goal assembly 12 includes only a single goal 18 as shown in FIG. 3. The goals 18 of both the end goal assembly 12 and the joint goal assembly 14 desirably are identical to permit ease of substitution during the erection of the courts 10. Each goal assembly 12, 14 comprises generally a base 16, a post 50 projecting upward from the base 16, a support arm 82 coupled to the post 50, a backboard 138 coupled to the support arm 82, and a basketball rim assembly 162 coupled to the backboard 138.

Figure 5:
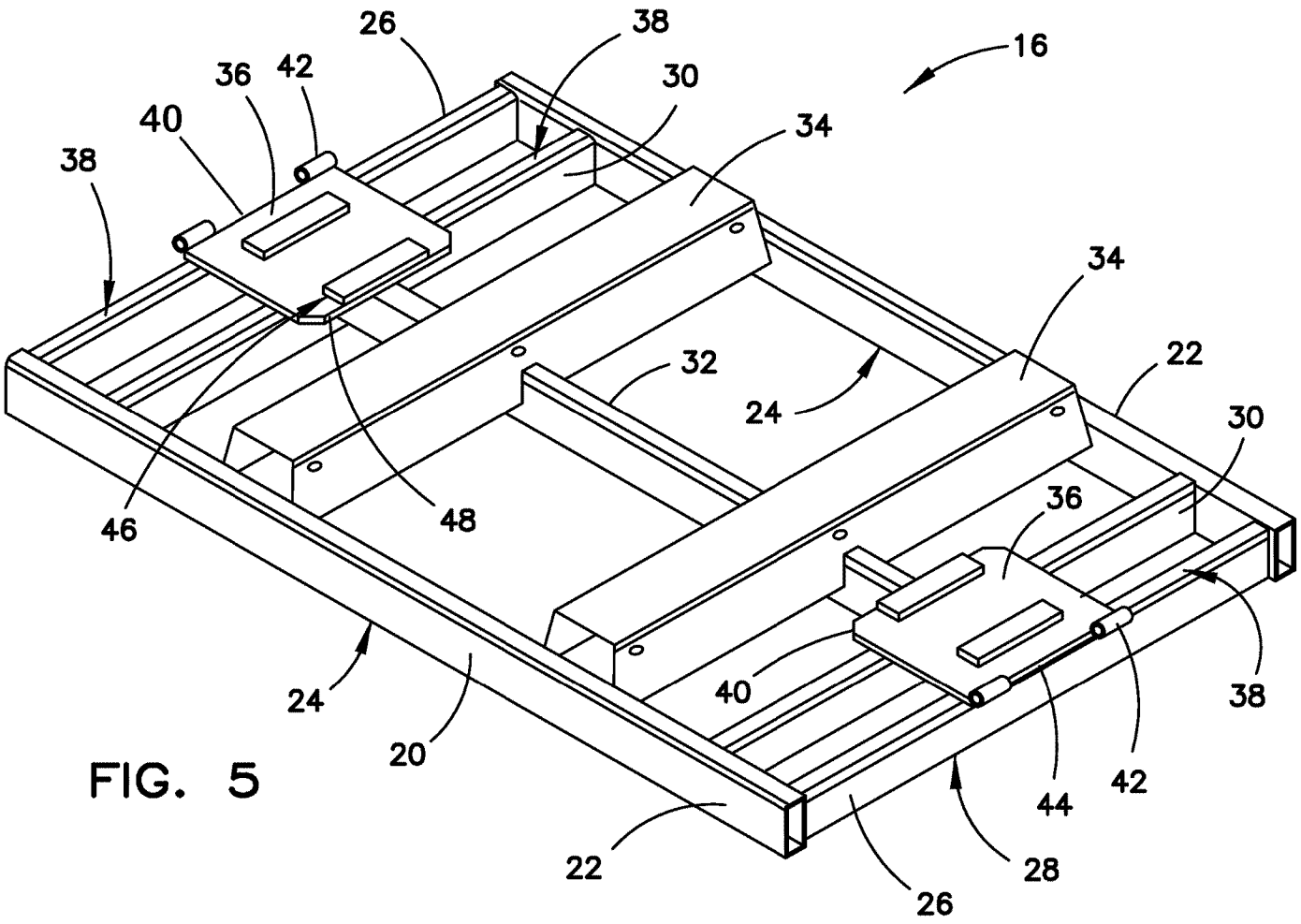
FIG. 5 is a perspective view of a base.

The base 16 can comprise a generally rectangular frame 20 as shown in FIG. 5 including a pair of parallel side bars 22 having a lower surface 24 for ground support. A pair of end bars 26 can be fixed to ends of the parallel side bars 22. Each of the end bars 26 can also include a lower surface 28 for ground support. Additional interior end bars 30 can be fixed in generally parallel relation to the end bars 26, and likewise include a lower surface for ground support. Additional bracing members 32, 34 can also be provided. Desirably, the bracing members 34 can take the form of inverted channel members sized and spaced from each other by a distance suitable to receive the forks of a fork-lift truck to permit easy transport of the base 16 and any attached structure from location to location as desired. A post coupling 36 can be fixed to an upper surface 38 of the end bars 26. The post coupling 36 can also be fixed to the upper surface 38 of the additional interior end bars 30. The post coupling 36 can comprise a plate 40 having a hinge defining element 42 at an outer edge 44 and an engagement element 46 at an inner edge 48.

Figure 6:
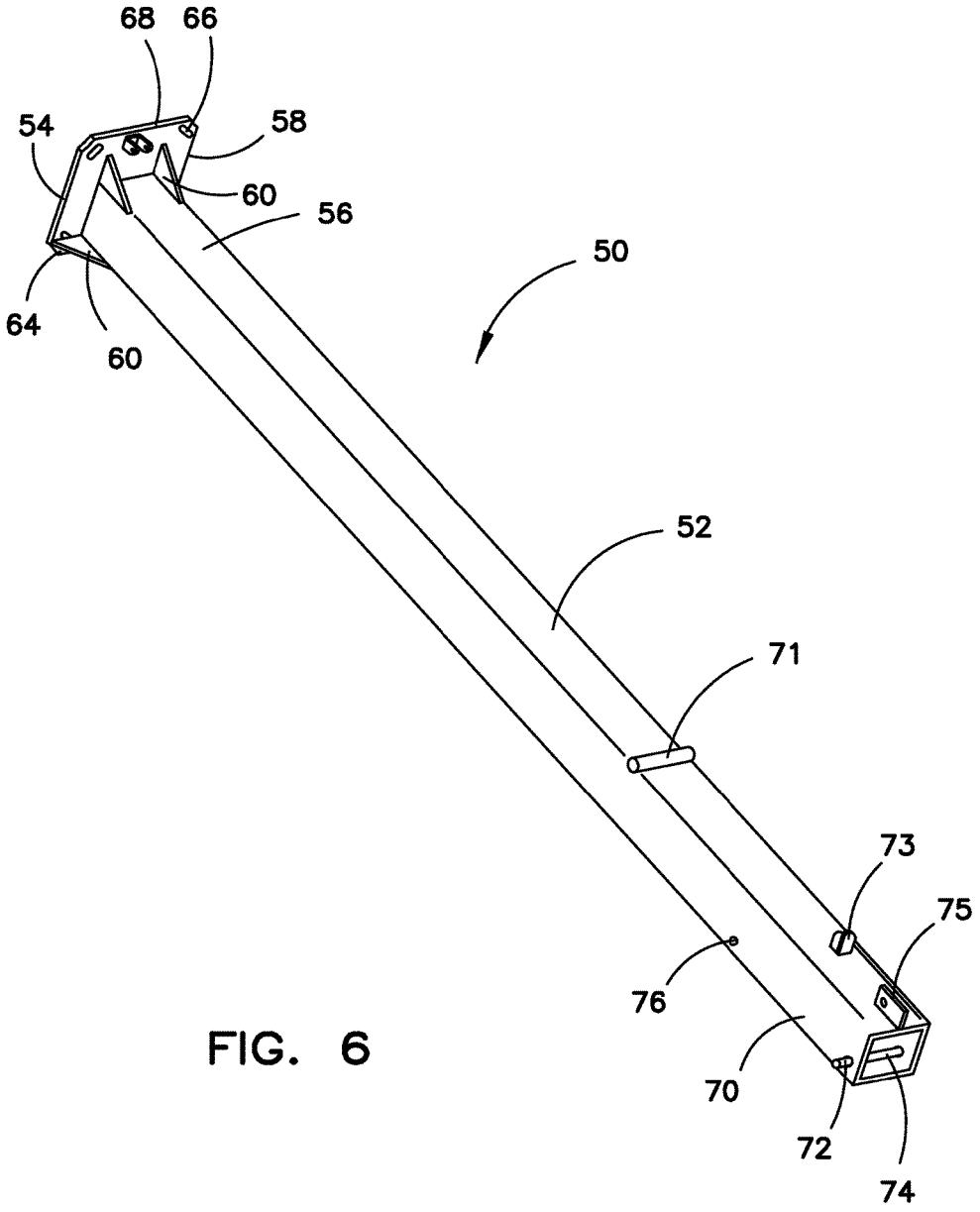
FIG. 6 is a perspective view of a post.
Figure 7:
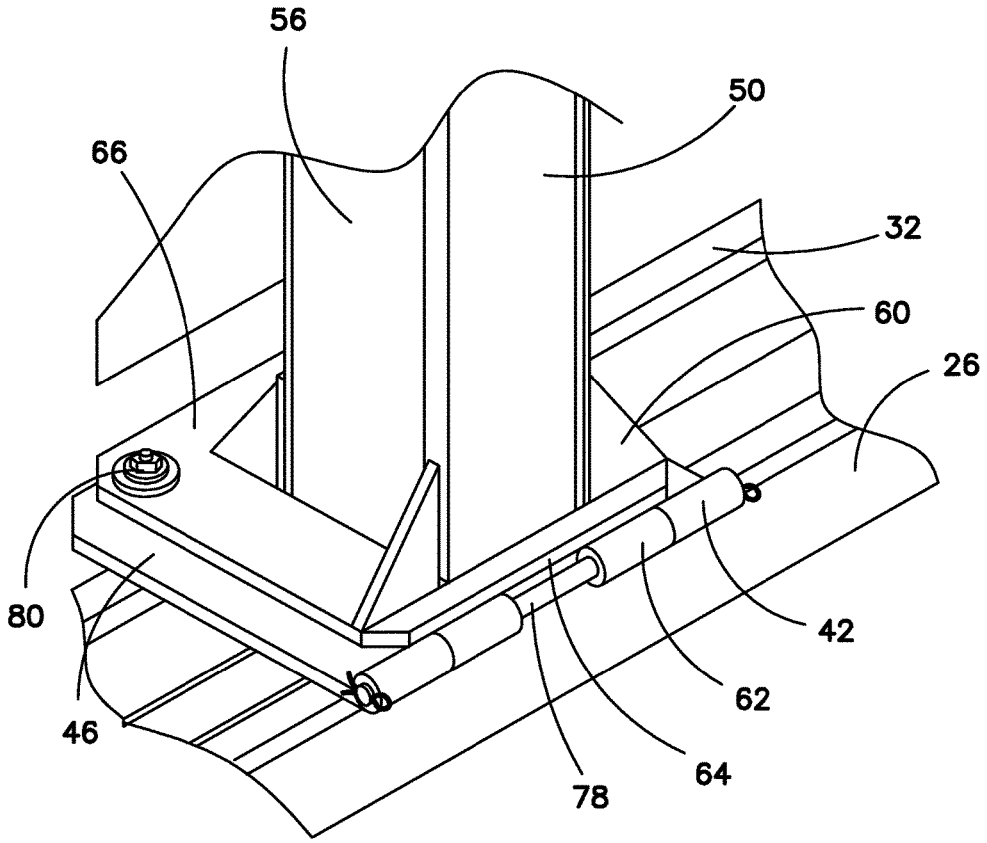
FIG. 7 is a detail perspective view of a coupling between a base and post.

The post 50 can comprise an elongated member 52, as shown in FIG. 6, formed, for example, of welded steel tubing. A base coupling 54 can fixed a lower end 56 of the post 50. The base coupling 54 can comprise a plate 58 secured to the post lower end 56 by a plurality of gussets 60. The base coupling 54 can include a hinge defining element 62, as shown in FIG. 7, located along a forward edge 64 and an engagement element 66 at a rearward edge 68. The post 50 can have an upper end 70 that can include a support arm coupling 72. The support arm coupling 72 can comprise pins 74 projecting laterally on each side of the post 50. The support arm coupling 72 can also include at least one lateral opening 76 through the post 50 sized to receive a fastener. The upper end 70 of the post 50 can also include an assembly stand coupling 71, a bracing post coupling 73, and a cable coupling 75.

FIG. 7 shows a detail perspective view of the lower end 56 of post 50 and coupling 54 secured to a post coupling 36 on base 16. The hinge defining element 42 of the post coupling 36 is shown to be pivotally secured to the hinge defining element 62 of base coupling 54 by a pivot pin 78. Additionally, the engagement element 46 of the post coupling 36 is shown to be secured to the engagement element 66 of base coupling 54 by fasteners 80. Upon release of the fasteners 80, the goal assembly 12, 14 can be pivoted around the pivot pin 78 between an erect, upright position shown in solid in FIG. 4 and a lowered position shown in phantom in FIG. 4 and in FIG. 17. The lowered position can facilitate the assembly and disassembly of the goal assembly 12, 14. The goal assembly 12, 14 can be supported in the lowered position by an assembly stand 77 that has an upper end 79 temporarily coupled to the assembly stand coupling 71. A lower end 81 of the assembly stand 77 can be variously located as necessary to support the goal assembly 12, 14 in the lowered position. The goal assembly 12, 14 can be moved between the lowered position and the erect, upright position with the aid of a cable 85 coupled to the cable coupling 75 and a winch 83 coupled to the base 16. Once in the erect, upright position, the goal assembly 12, 14 can be secured in that position by a bracing post 87 coupled between the base 16 and the bracing post coupling 73.

Figure 8:
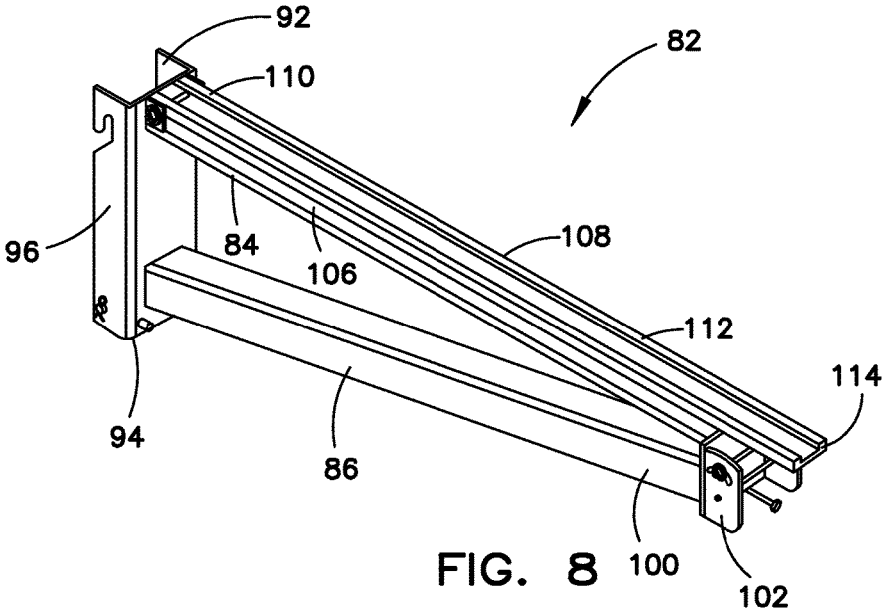
FIG. 8 is a perspective view of a support arm.
Figure 9:
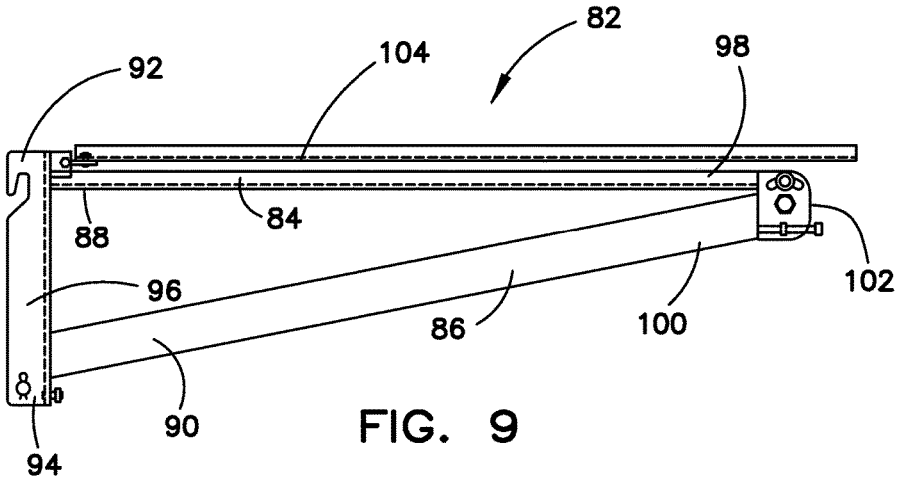
FIG. 9 is a side elevation view of a support arm.
Figure 10:
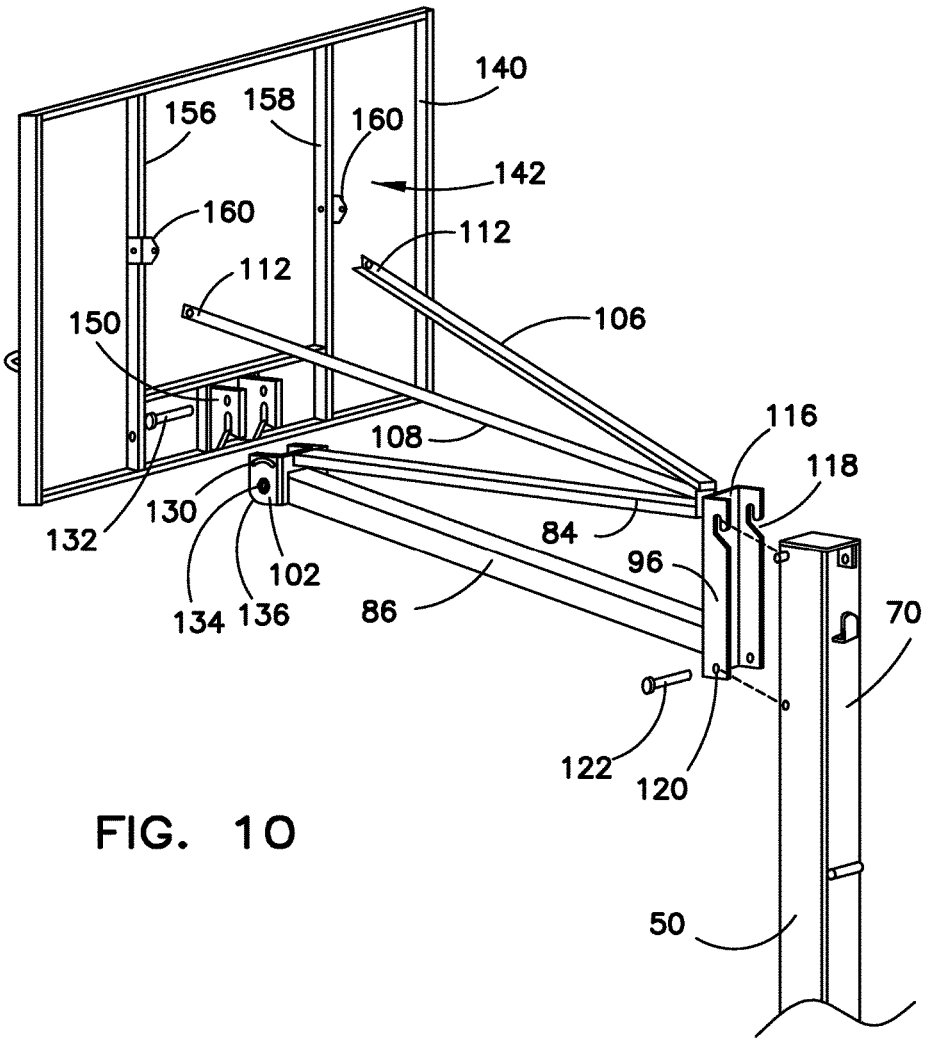
FIG. 10 is an exploded perspective view of the support arm in position between the post and the backboard.

The support arm 82 is shown in FIG. 8, FIG. 9, and FIG. 10. The support arm 82 can comprise a first arm 84 and second arm 86. Proximal ends 88, 90 of the first and second arms 84, 86 can be fixed, respectively, to an upper portion 92 and a lower portion 94 of a post coupling 96. Distal ends 98, 100 of the first and second arms 84, 86 can be fixed adjacent to each other to a backboard coupling 102. The first and second arms 84, 86, post coupling 96, and backboard coupling 102 can form a generally trapezoidal structure as shown best in FIG. 9. The support arm 82 can additionally include an upper backboard support 104. The upper backboard support 104 can include a pair of struts 106, 108 having first ends 110 pivotally coupled to the post coupling 96 and second ends 112 including an upper backboard engaging element 114.

Figure 11:
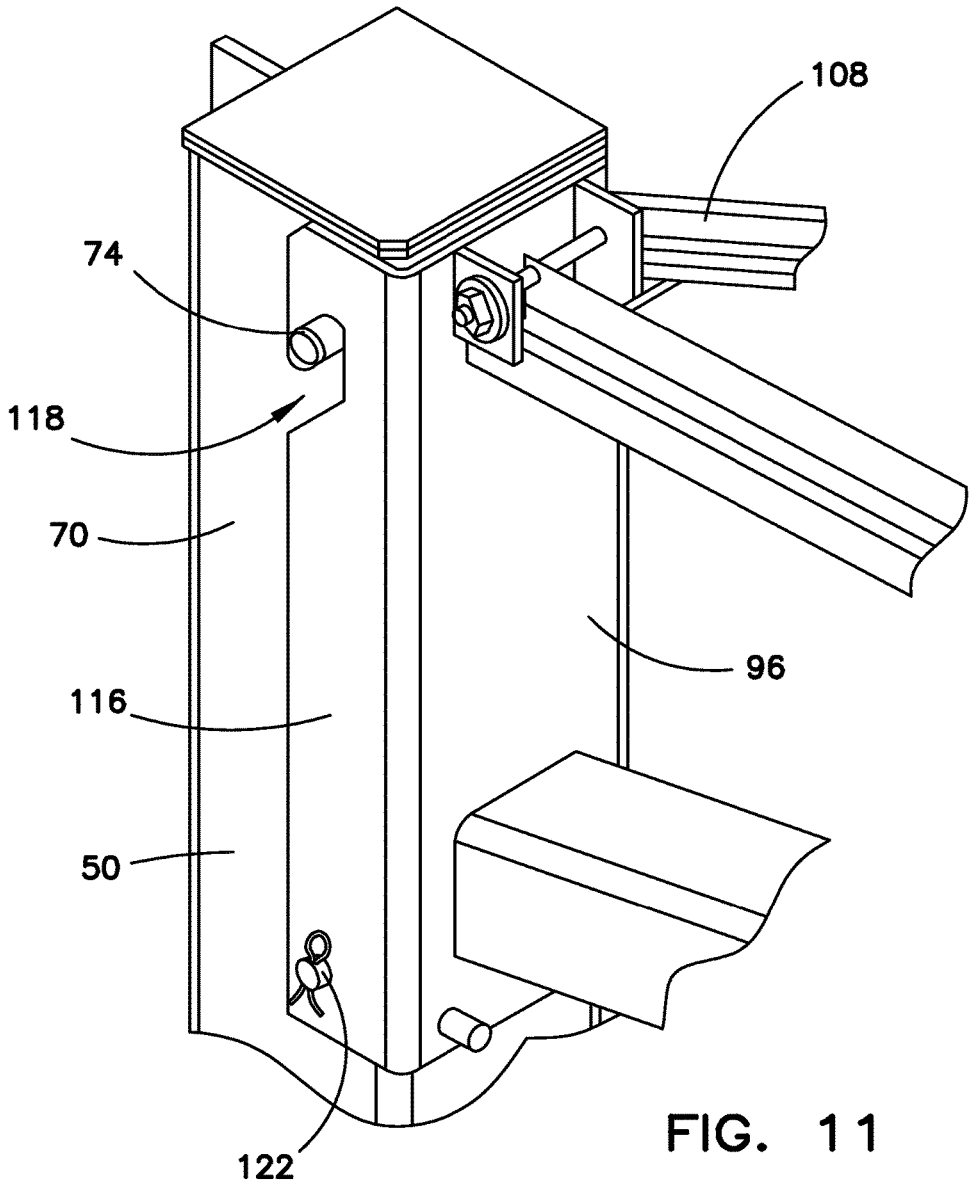
FIG. 11 is detail perspective of the support arm post coupling engaging the post.
Figure 13:
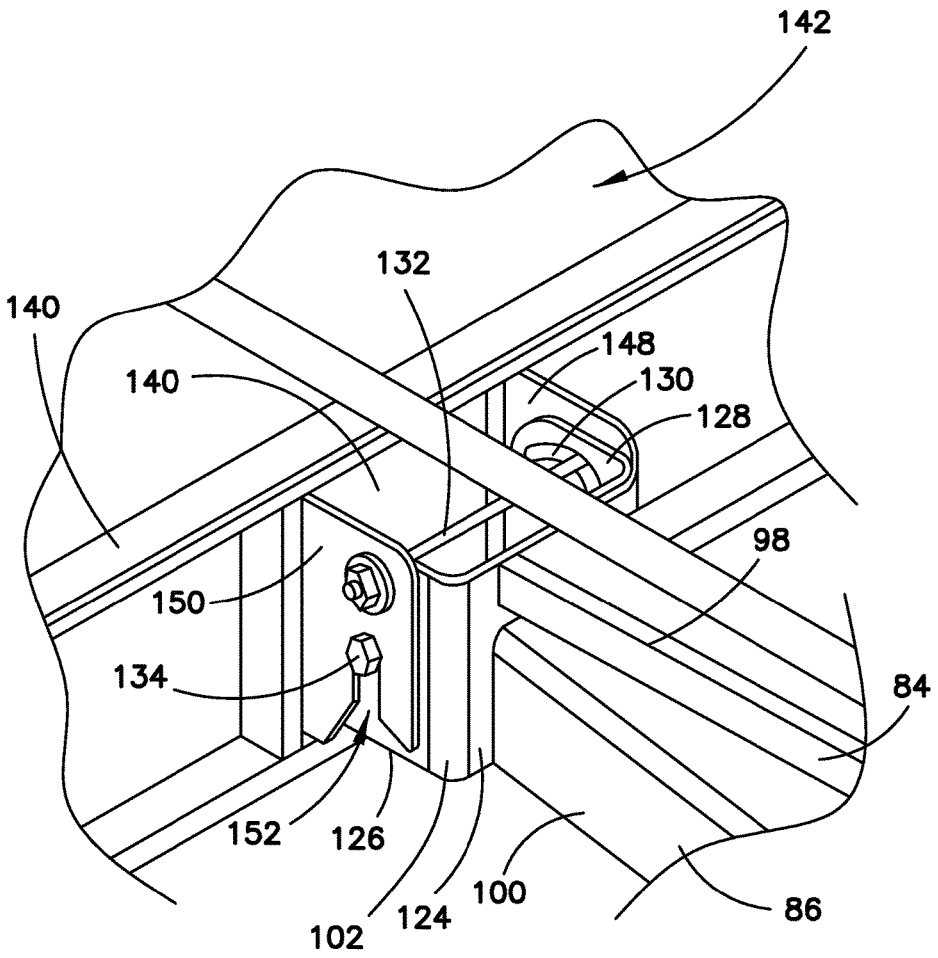
FIG. 13 is a detail perspective view of the support arm backboard coupling engaging the backboard.

The post coupling 96 can include a vertical channel member 116 sized to straddle the post upper end 70 as shown in FIG. 10 and FIG. 11. The channel member 116 can include a pair of slots 118 adapted to engage pins 74 projecting laterally on each side of the post 50. The channel member 116 can include additional openings 120 for receiving a fastening element 122. The backboard coupling 102 can include a plate 124 fixed to the distal ends 98, 100 of the first and second arms 84, 86 as shown in FIG. 13. A left flange 126 and a right flange 128 can extend forwardly from opposite sides of the plate 124. The flanges 126, 128 can include a slot 130 adapted to receive a laterally extending connecting pin 132. Another pin 134 can project laterally from outside surfaces 136 of the left and right flanges 126, 128.

Figure 12:
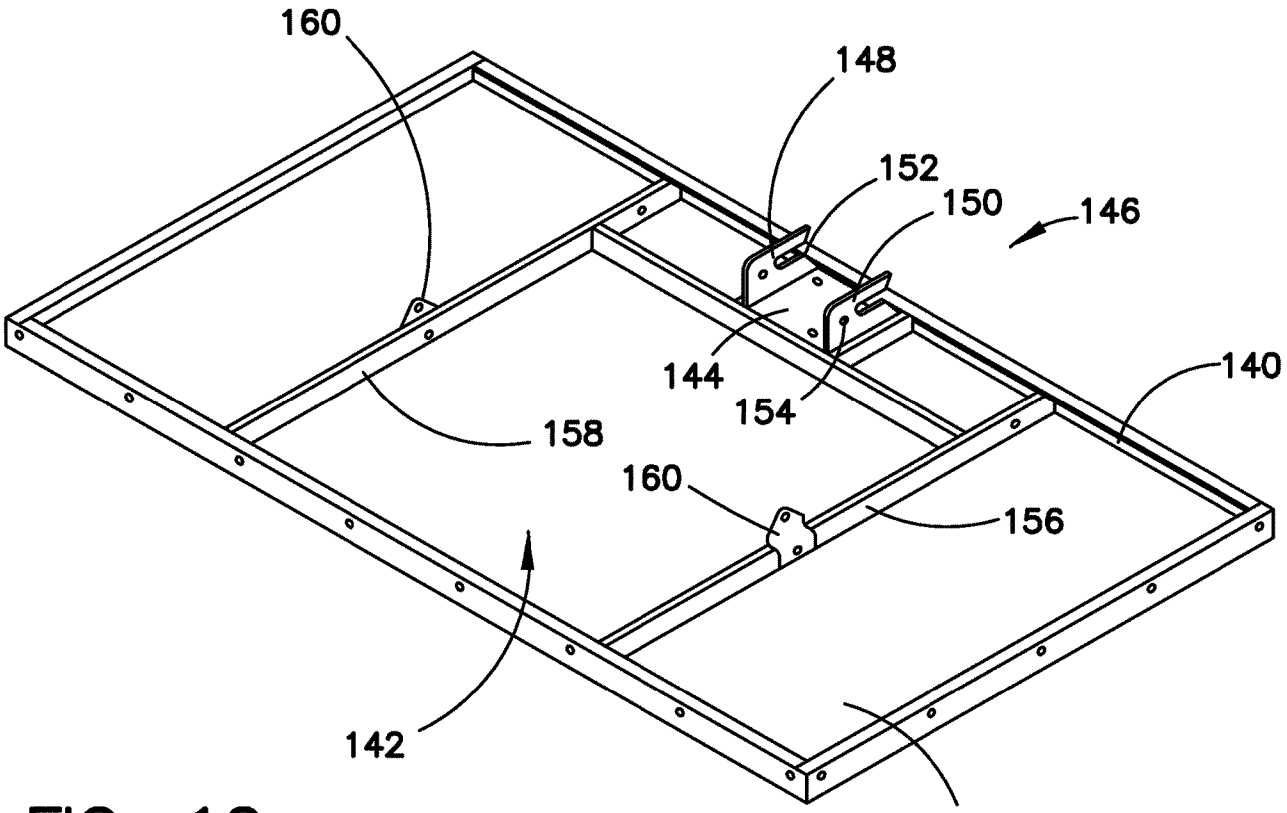
FIG. 12 is perspective view of the backboard and frame member including the arm coupling.

In FIG. 12, one can see a backboard 138 including a frame member 140 on a rear surface 142. The frame member 140 can include a support arm coupling 144 at a lower central location 146. The support arm coupling 144 can include webs 148, 150 projecting rearward from the frame member 140 that are spaced sufficiently from each other to straddle the backboard coupling 102 as shown in FIG. 13. Each web 148, 150 can include a downwardly opening slot 152 adapted to receive a laterally projecting pin 134 of the backboard coupling 102. Each web 148, 150 can also include an opening 154 to receive a connecting pin 132 that extends though the slot 130 of the backboard coupling 102. The frame member 140 can also include laterally spaced members 156, 158 including fastening elements 160 to couple to the second ends 112 of the backboard supporting struts 106, 108 as shown in FIG. 10.

Figure 14:
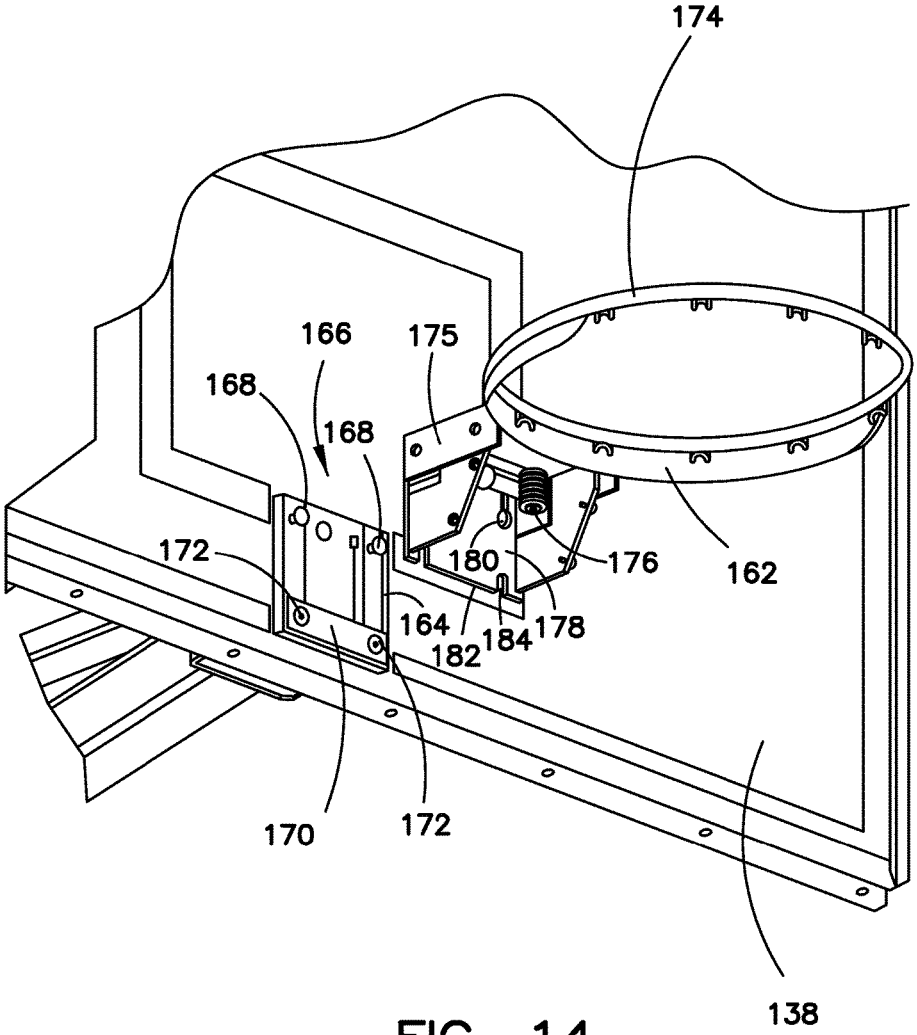
FIG. 14 is an exploded perspective view of a basketball rim and backboard support coupling.

FIG. 14 is an exploded perspective view of the backboard 138 and the basketball rim assembly 162. A rim assembly coupling 164 can be fixed to a lower central position of a front surface 166 of the backboard 138. The rim assembly coupling 164 can include one or more broad-headed fasteners 168. The rim assembly coupling 164 can also include a pinch bar 170 coupled to the backboard 138 by fasteners 172. The basketball rim assembly 162 can include a rim 174. The rim 174 can be fixed to a rim support 175 that can include break-away mechanism 176 designed to compensate for deflection of the rim 174 by players impacting or hanging on the rim. The rim support 175 can include a back plate 178 having one or more inverted keyhole shaped openings 180 sized and spaced to receive the one or more broad-headed fasteners 168 of the rim assembly coupling 164. The back plate 178 of the rim support 175 can additionally include a lower edge 182, which can be inserted into the pinch bar 170. The pinch bar 170 is attached to the front surface 166 with fasteners 172. The basketball rim assembly 162 can be quickly coupled to the rim assembly coupling 164 by positioning the back plate 178 so that the one or more broad-headed fasteners 168 of the rim assembly coupling 164 protrude into the one or more inverted keyhole shaped openings 180. The back plate 178 is then lowered so that the rim support lower edge slips between the backboard front surface 166 and the pinch bar 170. The fasteners 168 can then be tightened to secure the back plate 178 to the rim assembly coupling 164.

Figure 15:
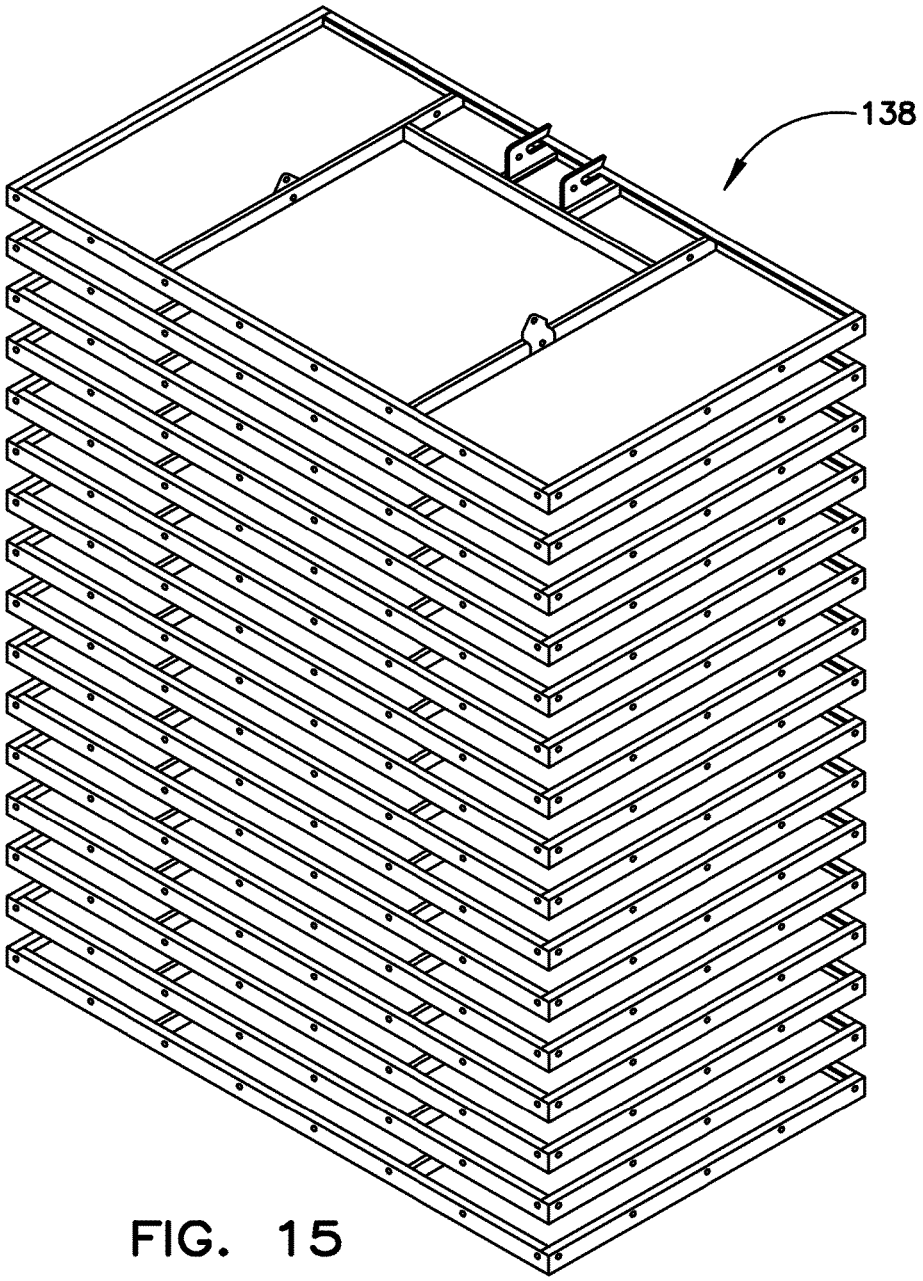
FIG. 15 is a perspective view of a stack of 16 backboards with the basketball rim removed from the backboard.
Figure 16:
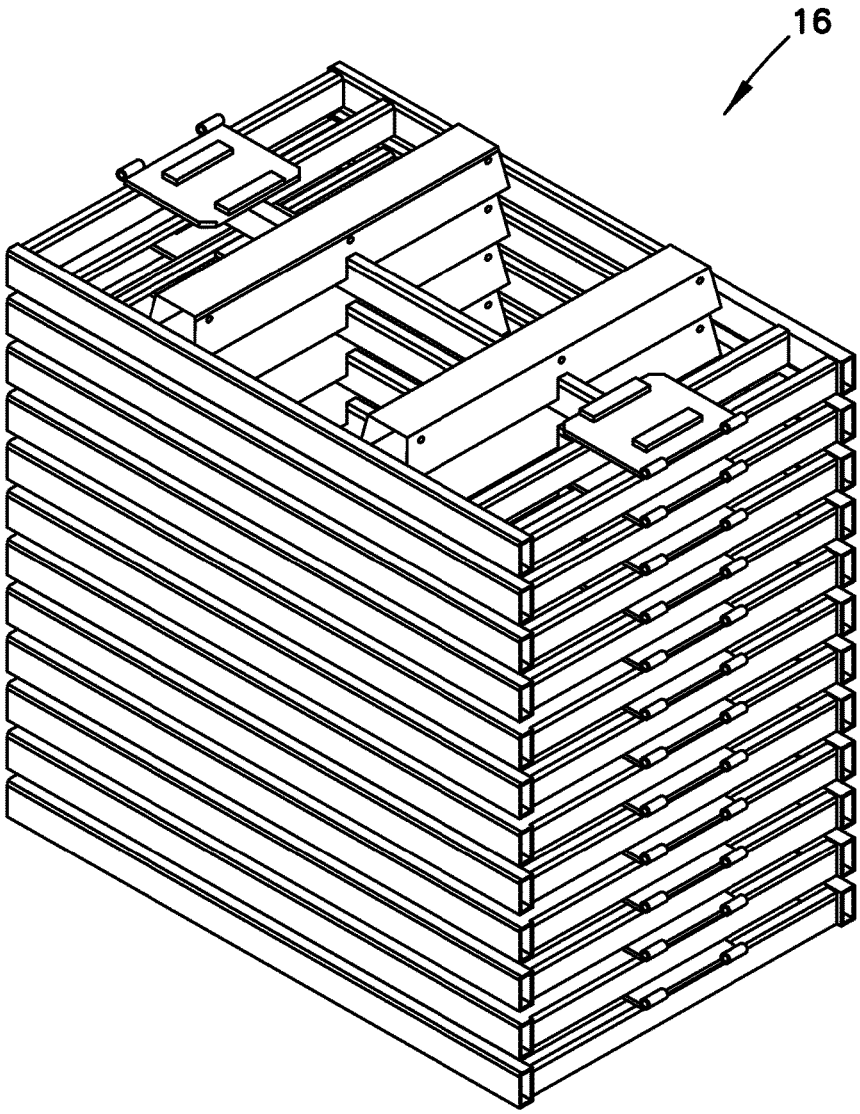
FIG. 16 is a perspective view of a stack of 12 bases needed for the eight court layout shown in FIG. 1.

The system contemplates a plurality of basketball goals 12, 14 assembled for a tournament at a site such as that illustrated in FIG. 1. For example, the system can include twelve bases 16, and sixteen of each of the other components to form eight basketball courts 10. When disassembled and stacked, as shown in FIG. 16, the twelve bases 16 would occupy a volume of less than 160 cubic feet. When disassembled and stacked, the sixteen posts 50 would occupy a volume of less than 170 cubic feet. When disassembled and stacked, the sixteen support arm assemblies 82 would occupy a volume of less than 95 cubic feet. When disassembled and stacked, as shown in FIG. 15, the sixteen backboards 138 would occupy a volume of less than 220 cubic feet. When disassembled and stacked, four of the sixteen basketball goal assemblies 12, 14, for a total of sixty-four basketball goals to equip thirty-two courts 10, can be loaded into a standard 53 foot truck, which is far less volume than is required by prior systems. Carts can optionally be provided to facilitate the loading of the stacked support arm assemblies and stacked goal assemblies.

Figure 4:
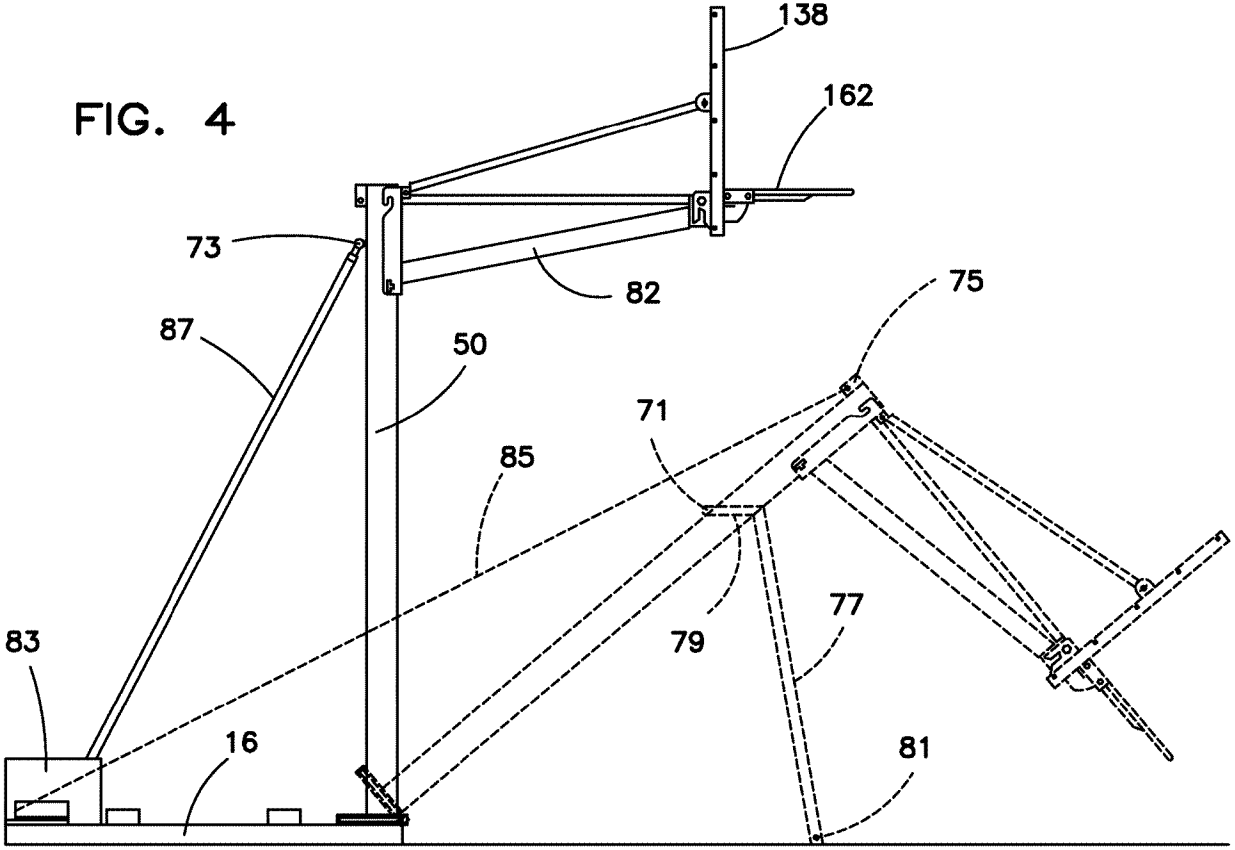
FIG. 4 is a side elevation view of an end basketball goal shown in solid in an erect position and in phantom in a lowered position.
Figure 17:
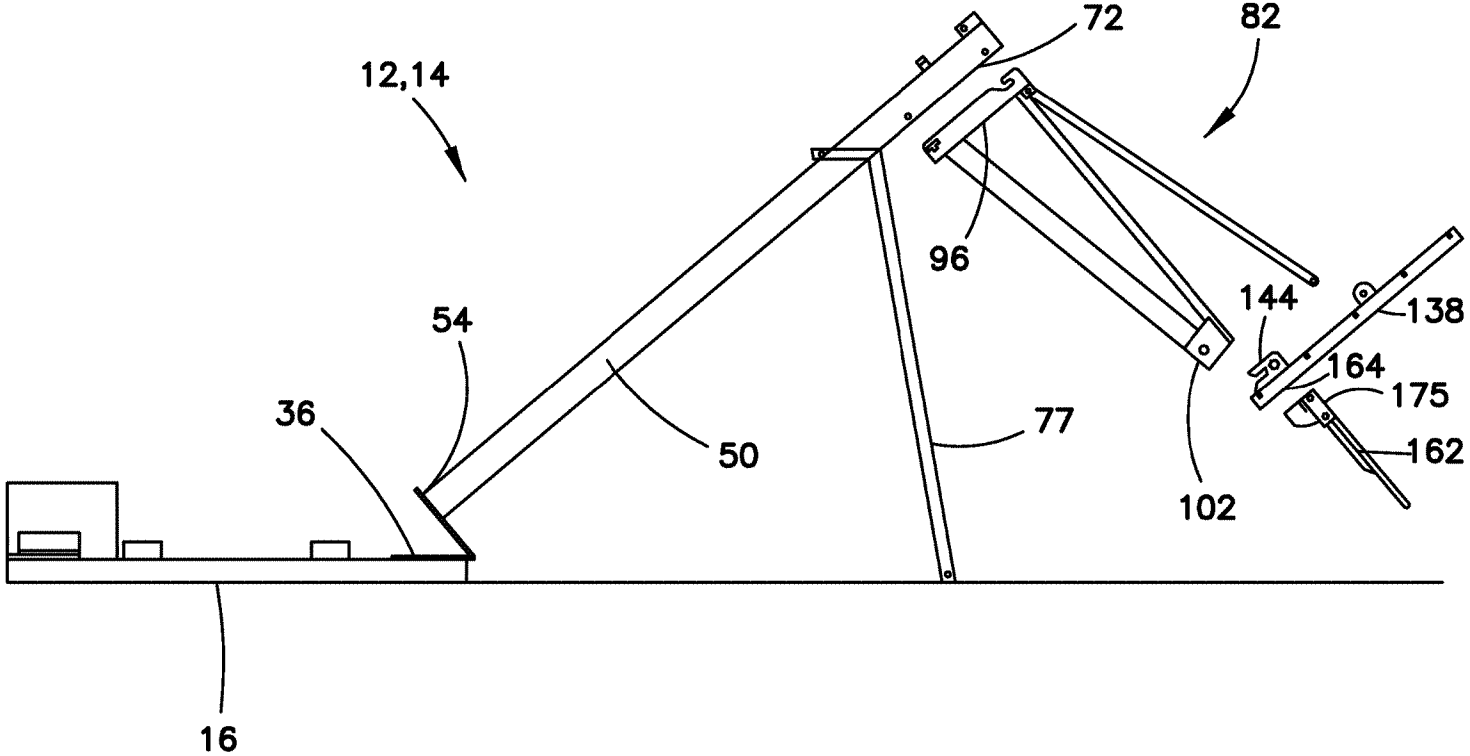
FIG. 17 is an exploded side elevation view of the basketball goal of FIG. 4 in the lowered position.

The lowered position, shown in FIG. 17, can facilitate the assembly and disassembly of the goal assembly 12, 14. The goal assembly 12, 14 can be supported in the lowered position by an assembly stand 77. The goal assembly 12, 14 can be quickly assembled by coupling the base coupling 54 on post 70 to the post coupling 36 on base 16 by a pivot pin 78. The support arm 82 can then be coupled to the support arm coupling 72 on upper end of post 70 by engaging the slots 118 in the post coupling 96 with the pin 74 and securing the channel member 116 to the post 70 with fastening element 122. The backboard 138 can then be coupled to the support arm 82 by slipping the downward opening slots 152 of the support arm coupling 144 over the laterally projecting pin 134 of the backboard coupling 102. Laterally extending connecting pin 132 is then inserted through openings 154 in the support arm coupling 144 and the slot 130 in flanges 126, 128 of backboard coupling 102. The basketball rim assembly 162 can be quickly coupled to the rim assembly coupling 164 by positioning the back plate 178 so that the one or more broad-headed fasteners 168 of the rim assembly coupling 164 protrude into the one or more inverted keyhole shaped openings 180. The back plate 178 is then lowered so that the rim support lower edge slips between the backboard front surface 166 and the pinch bar 170. The fasteners 168 can then be tightened to secure the back plate 178 to the rim assembly coupling 164. The goal assembly 12, 14 can then be moved between the lowered position supported by assembly stand 77 to the erect, upright position with the aid of a cable 85 coupled to the cable coupling 75 and a winch 83 coupled to the base 16, as shown in FIG. 4. Once in the erect, upright position, the goal assembly 12, 14 can be secured in that position by a bracing post 87 coupled between the base 16 and the bracing post coupling 73. While no particular order of assembly is necessarily favored, this particular order may minimize the weight of the elements being handled during assembly. The disassembly process can be the reverse of this process. Padding can optionally be fastened to the post 70 to provide safety for tournament participants.

It is therefore intended that the foregoing detailed description be regarded as illustrative rather than limiting, and that it be understood that it is the following claims, including all equivalents, that are intended to define the spirit and scope of this invention.

What is claimed is:

1. A basketball goal system comprising:

a base comprising a first post coupling element and a second post coupling element, the first post coupling element and the second post coupling element fixedly mounted at opposing ends of the base;

a first post and a second post, each of the first post and the second post including a lower end, an upper end, and a single rigid elongated member extending from the lower end to the upper end of the first and second posts, the lower end of the first and second posts comprising a base coupling element fixedly mounted at the lower end, the base coupling element of each of the first post and the second post respectively and independently detachably engaged with the first post coupling element and the second post coupling element at opposing ends of the base, the post upper end of each of the first post and the second post including an arm coupling element fixedly mounted adjacent the upper end and projecting laterally from opposing sides of the single rigid elongated member;

a first arm assembly and a second arm assembly, each of the first arm assembly and the second arm assembly including a post coupling fixed to a first end, the post coupling comprising a vertical channel member that includes a base member and opposing wall members extending perpendicularly away from the base member to straddle and cooperatively operate to at least partially surround the elongated member, the base member sized to contiguously align and vertically extend along the elongated member from a first end of the post coupling to a second end of the post coupling, the channel member comprising a pair of slots formed in the opposing wall members at the first end of the post coupling and adapted to slidably engage the arm coupling element projecting laterally on opposing sides of the elongated member;

each of the first arm assembly and the second arm assembly comprising a first support arm and a second support arm, the first support arm configured to engage the base member proximate the first end of the post coupling, and the second support arm configured to engage the base member proximate the second end of the post coupling so as to bias the base member to maintain contiguous contact with the elongated member and the arm coupling element, each of the first arm assembly and the second arm assembly including a backboard coupling element fixed to a second end thereof, both the first support arm and the second support arm coupled to the backboard coupling element;

a first backboard and a second backboard, each of the first backboard and the second backboard respectively engaging the backboard coupling element fixed to the second end of the first arm assembly and the second arm assembly; and a first basketball rim assembly and a second basketball rim assembly coupled to the first backboard and the second backboard, respectively, and positioned opposite the backboard coupling element.

2. The basketball goal system of claim 1, wherein the first post and the second post are coupled at the opposing ends of the base to operate as a counter balance to each other.

3. The basketball goal system of claim 1, wherein the base comprises parallel side bars and a pair of end bars fixed to ends of the parallel side bars to form a rectangular structure that is configured to be positioned on a floor with the first backboard and the second backboard facing in opposing directions, each of the pair of end bars having a bottom surface for ground support, and top surface upon which the first and second post coupling elements are fixedly mounted.

4. The basketball goal system of claim 1, wherein the first arm assembly extends in a first direction such that the first backboard is position above and away from the base in the first direction, and the second arm assembly extends in a second direction such that the second backboard is positioned above and away from the base in the second direction, the first direction being opposite the second direction.

5. The basketball goal system of claim 4, wherein a weight of the first arm assembly and the first backboard is operable as a counterweight for the second arm assembly and the second backboard, and the second arm assembly and the second backboard is operable as a counterweight for the first arm assembly and the first backboard.

6. The basketball goal system of claim 1, further comprising a first bracing post coupled between the lower end of the first post and the upper end of the second post, and a second bracing post coupled between the lower end of the second post and the upper end of the first post.

7. The basketball goal system of claim 1, wherein the base comprises a rectangular frame including first and second parallel end bars at opposing ends of the base and interior end bars positioned in parallel and spaced away from end bars such that each of the first post coupling element and the second post coupling element each include a flat plate coupled with and extending between the respective end bars and the interior end bars at opposing ends of the base, and a hinge element included along a peripheral edge of each of the first post coupling element and the second post coupling element is positioned closest to the respective end bars at opposing ends of the base.

8. The basketball goal system of claim 1, wherein the lower end of each of the first and second posts includes a hinge element fixedly coupled thereto as a part of the base coupling element, and the upper end of each of the first and second posts includes at least one pin projecting laterally on each side of the elongated member as a part of the arm coupling element.

9. The basketball goal system of claim 1, wherein the pair of slots are adapted to engage corresponding members projecting transversely outward from opposing surfaces of the elongated member, the corresponding members positioned on the opposing surfaces to be offset from a centerline of the elongated member to bias the second end of the post coupling into contiguous contact with the elongated member, the corresponding members included as part of the arm coupling element.

10. The basketball goal system of claim 1, wherein the backboard coupling element includes a yoke member having a middle plate, and right and left webs projecting from opposite lateral sides of the middle plate, the right and left webs formed to include a slot to receive a connecting pin laterally extending between the slots, and a fastening pin projecting laterally from each side of the yoke member to couple the backboard coupling element to the respective first backboard or the second backboard.

11. The basketball goal system of claim 1, wherein each of the first backboard and the second backboard includes on a rear surface a rectangular frame, and, the backboard coupling element comprising a yoke member including a central plate fixedly coupled to the rectangular frame, and a left web and a right web fixed to the central plate, the left and right webs extending rearward from the backboard rear surface to engage the backboard coupling element fixed to the arm assembly.

12. A basketball goal system comprising:

a base comprising a rectangular frame including first and second parallel end bars, the first and second parallel end bars positioned at opposite ends of the base and each including opposing sides such that a first side is configured to face a floor surface or a ground surface, and a second side of each of the end bars includes a first hinge element fixedly coupled thereto, the first side opposite the second side;

a first post and a second post, each of the first post and the second post including a lower end, an upper end, and a single rigid elongated member extending between the lower end and the upper end, the lower end including a second hinge element fixedly coupled thereto, the upper end including pins projecting laterally on opposing sides of the elongated member and positioned offset from intersection with a central axis of the opposing sides of the elongated member;

a first pin pivotally coupling the second hinge element included at the lower end of the first post to one of the first hinge elements included on the base, and a second pin pivotally coupling the second hinge element included at the lower end of the second post to another of the first hinge elements included in the base;

a first arm assembly and a second arm assembly, each of the first and second arm assemblies including a respective vertical channel member that includes a base member and opposing wall members extending perpendicularly away from the base member to straddle and respectively surround a portion of the elongated member of each of the respective first and second posts and extend from a first end of the post coupling element proximate the upper end of the respective first and second posts to a second end of the post coupling element positioned toward the lower end of the respective first and second posts, the channel member having a pair of slots adapted to engage the pins projecting laterally on opposing sides of the respective elongated member of the first and second posts to bias the second end of the post coupling element against the respective elongated member of the first and second posts;

each of the first arm assembly and the second arm assembly further including a first horizontally extending support member and a second horizontally extending support member each having a first end independently fixed to the vertical channel member to bias the vertical channel member to rest against the elongated member of the first post or the second post, respectively, and a second end fixed to a backboard coupling that is coupled to a yoke member, the yoke member comprising a middle plate and right and left webs projecting from opposite lateral sides of the middle plate and away from the horizontally projecting support member, and a pin projecting laterally from each side of the yoke member for receipt by the pair of slots; and a first basketball goal and a second basketball goal, each of the first basketball goal and the second basketball goal including a backboard having a peripheral frame coupled to the yoke member, a rim coupling element fixed to a lower front surface of the backboard, and a rim assembly coupled to the rim coupling element.

13. The basketball goal system of claim 12, further comprising a first assembly support stand coupling element fixedly coupled with an upper end portion of the elongated member of the first post and a second assembly stand coupling element fixedly coupled with an upper end portion of the elongated member of the second post, the first assemble stand coupling element and the second assemble stand coupling element configured to respectively support the first post and the second post in a non-erect position during assembly of the basketball goal system.

14. The basketball goal system of claim 12, further comprising a first bracing post coupling element fixedly coupled at the upper end of the elongated member of the first post to secure the first post in an erect position during play, and a first cable element fixedly coupled at the upper end of the elongated member of the first post to facilitate movement of the first post between the non-erect position and the erect position and a second bracing post coupling element fixedly coupled at the upper end of the elongated member of the second post to secure the second post in an erect position during play, and a second cable element fixedly coupled at the upper end of the elongated member of the second post to facilitate movement of the second post between the non-erect position and the erect position.

15. The basketball goal system of claim 12, wherein the base further comprises a pair of parallel extending fork pockets, each of the fork pockets formed as a three sided channel to receive a fork tine of a forklift truck and to allow a plurality of bases to be vertically stacked with the fork pockets of different bases aligned to nest within each other.

16. A transportable basketball goal system comprising:

a first post and a second post that each include a respective elongated member extending laterally between a base coupling element at a lower end and a support arm coupling element at an upper end;

a base comprising a first post coupling element and a second post coupling element, the first post coupling element and the second post coupling element each comprising a flat plate fixedly mounted at opposing ends of the base and each including a respective first portion of a hinge element formed to receive a pivot pin;

the base coupling element comprising a base plate fixedly coupled to the lower end and including a second portion of a hinge element located along a forward edge of the base plate and formed to receive the pivot pin;

the base coupling element also including an engagement element at a rearward edge of the base plate to arrest pivotal movement of the base plate and the elongated member around the pivot pin at the forward edge of the base plate;

the upper end of each of the first post and the second post including a support arm coupling element including a pin projecting laterally on opposing sides of the elongated member and a lateral opening formed in each of the first post and the second post below the pin and extending through the elongated member, the lateral open being sized to receive a fastener;

a first arm assembly coupled with the first post and a second arm assembly, coupled with the second post to extend in opposite directions;

each of the first arm assembly and the second arm assembly including a first arm member, a second arm member, a post coupling independently fixed to a proximate end of both the first arm member and the second arm member, and a backboard coupling element fixed to an opposite distal end of the first arm member and the second arm member;

the post coupling comprising a channel member comprising a pair of slots adapted to engage the pin projecting laterally on opposing sides of the elongated member so as to align an opening in the channel member with the opening extending through the elongated member, the proximate end of the first arm member fixedly coupled with the post coupling proximate the pair of slots, and the proximate end of the second arm member fixedly coupled with the post coupling proximate the opening extending through the elongated member so as to bias the channel member to contiguously align with the elongated member;

a first basketball goal and a second basketball goal, each of the first basketball goal and the second basketball goal coupled with backboard coupling element at the distal end of the support arm of the respective first post or the second post, and including a backboard having a peripheral frame, a rim coupling element fixed to a lower front surface of the backboard, and a rim assembly coupled to the rim coupling element.

17. The transportable basketball goal system of claim 16, wherein the base plate of the base coupling element and the flat plate of the base are positionable in parallel and coupled by a fastener to arrest pivotal movement of the base plate and the elongated member around the pivot pin at the forward edge of the base plate.

18. The transportable basketball goal system of claim 16, wherein the first basketball goal is extended away from the first post by the arm assembly a same distance that the second basketball goal is extended away from the second basketball goal, the first basketball goal and the second basketball goal extended in opposite directions.

19. The transportable basketball goal of claim 16, further comprising a first bracing post coupling the base coupling element of the first post with the second post at the upper end to secure the second post in an erect position, and a second bracing post coupling the base coupling element of the second post with the first post at the upper end to secure the first post in an erect position.

20. The transportable basketball goal of claim 16, wherein the channel member is sized to straddle, at least partially surround, and laterally extend along the elongated member from adjacent the post upper end toward the lower end of the respective first and second posts, such that the channel member is slidable along the elongated member toward the lower end to engage the pin with the slots and align the opening in the channel member with the lateral opening extending through the elongated member.

* * * * *